United States Patent [19]

Chateau

[11] 4,089,377

[45] May 16, 1978

[54] SEAL ADAPTOR ALIGNMENT MEANS AND LANDING TOOL AND METHOD

[75] Inventor: Georges M. Chateau, Pau, France

[73] Assignee: Societe Nationale Elf Aquitaine (Production), Courbevoie, France

[21] Appl. No.: 763,112

[22] Filed: Jan. 27, 1977

[51] Int. Cl.[2] ..... E21B 33/03; E21B 23/00

[52] U.S. Cl. ..... 166/315; 166/85; 285/18; 285/DIG. 15

[58] Field of Search ..... 166/315, 85, 89; 285/DIG. 15, 18, 28, 29, 137 A

[56] References Cited

U.S. PATENT DOCUMENTS

| | | | |
|---|---|---|---|
| 3,096,135 | 7/1963 | Feustel et al. | 285/DIG. 15 |
| 3,194,588 | 7/1965 | Buckey et al. | 285/DIG. 15 |
| 3,551,005 | 4/1969 | Brun | 285/18 |
| 3,807,497 | 4/1974 | Baugh | 166/85 |

*Primary Examiner*—James A. Leppink
*Attorney, Agent, or Firm*—Poms, Smith, Lande & Glenny

[57] ABSTRACT

An adaptor means for aligning two members to be connected in coaxial, sealed relationship in which the adaptor means includes an adaptor body member having an inner central portion with a throughbore and of preselected length, at least two-part cylindrical or arcuate segments spaced radially outwardly of said inner portion and in concentric relation thereto, said arcuate segments having a length greater than the length of the inner portion; and tubular nipple members carried in passageways in said body member, said tubular members having a length not greater than the length of the inner portion or the segments and lying on a radian between a segment and the inner portion. The arcuate segments each subtend a different angle and are slidably, precisely received in corresponding arcuate recesses provided on a mandrel end of a well tool for precise alignment of the tubular nipple member with a passageway in the well tool. A landing tool and landing technique for locating a tubing hanger in a wellhead assembly in a precise position whereby said seal adaptor means may be properly aligned and mated with said tubing hanger. A landing tool and landing technique in which a tubing hanger is supported above its landed position while being angularly oriented, and when once oriented is lowered into landed position without turning or loss of such angular orientation.

27 Claims, 9 Drawing Figures

SEAL ADAPTOR ALIGNMENT MEANS AND LANDING TOOL AND METHOD

BACKGROUND OF INVENTION

In offshore subsea well operations, it is desirable to conduct many of the operations at great depths and without diver assistance. Such well operations at any depth require precise remote control of equipment. In copending application Ser. No. 743,586 owned by a common assignee, a subsea station is described which provides wellhead, production, and control modules or assemblies which may be assembled with the subsea station without diver assistance and by use of remote control means. Such a subsea station includes guide posts to which may be connected guide lines by remote control means to facilitate the lowering of equipment along such guide lines and provided with cooperable guide tubes to initially locate and position such lowered well equipment. Such well equipment may include a tubing hanger to be assembled with a well casing or a wellhead assembly at the subsea station, the tubing hanger including fluid conducting passageways for fluid control circuits and annulus lines. Such fluid conducting passageways must be connected with corresponding fluid conducting passageways carried by adjacent well equipment such as a safety tree assembly for production of the well. Fluid interconnection of such passageways requires precise alignment both axially and angularly to avoid leakage and also to avoid damage to tubular nipple members providing a coupling interconnection between two adjacent well members.

Prior proposed means for connecting fluid passageways in two adjacent well members have usually included an arrangement whereby divers or remote control robots may accomplish such a connection. Under diver or robot assistance, the ends of the well members to be interconnected in fluid conducting relationship were often difficult to precisely align and index, and when such misalignment occurred, damage to the seals and the connecting members might occur. At relatively great water depths, such prior methods and constructions used to accomplish such assembly were time-consuming and difficult.

SUMMARY OF INVENTION

The present invention relates to a seal adaptor means for interconnecting in sealed relation fluid passageways in a tubing hanger with corresponding passageways in a safety tree assembly, said tubing hanger being landed by a novel landing tool and landing technique whereby said tubing hanger is precisely angularly indexed in a subsea wellhead assembly.

An object of the present invention is to provide a novel means for landing a tubing hanger in a wellhead assembly and connecting the tubing hanger to a safety tree assembly or the like.

Another object of the present invention is to provide a novel means for accomplishing precise coaxial and angular alignment of one or more fluid conducting passageways in adjacent well members to be interconnected in fluid communication.

Another object of the present invention is to provide a seal adaptor means having at least two part-cylindrical or arcuate segments extending therefrom for alignment with a mandrel end of a tubing hanger and for selected angular registration of said adaptor means with said mandrel end.

Still another object of the present invention is to provide a novel construction of a seal adaptor member in which tubular fluid conducting nipple members carried thereby are arranged with respect to the adaptor member to protect said tubular nipple members against damage during assembly of the adaptor means with a tubing hanger mandrel.

A still further object of the present invention is to provide a landing tool and landing technique wherein said tubing hanger may be precisely positioned in a well casing or wellhead assembly and wherein said landing tool may be readily retrieved.

Numerous other objects and advantages of the present invention will be readily apparent from the following description of the drawings in which exemplary embodiments of the present invention are shown.

IN THE DRAWINGS

Figure 1:
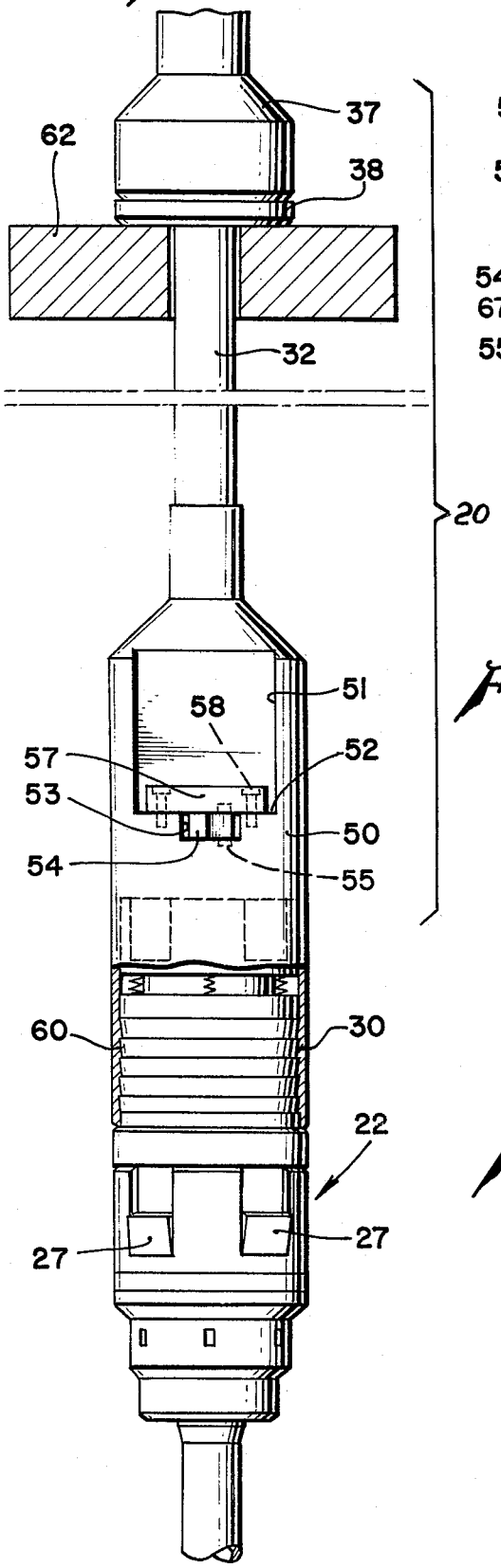
FIG. 1 is a fragmentary elevational view of a tubing hanger suspended from a pipe string prior to being landed in a well casing, the tubing hanger having a construction in accordance with this invention.
Figure 3:
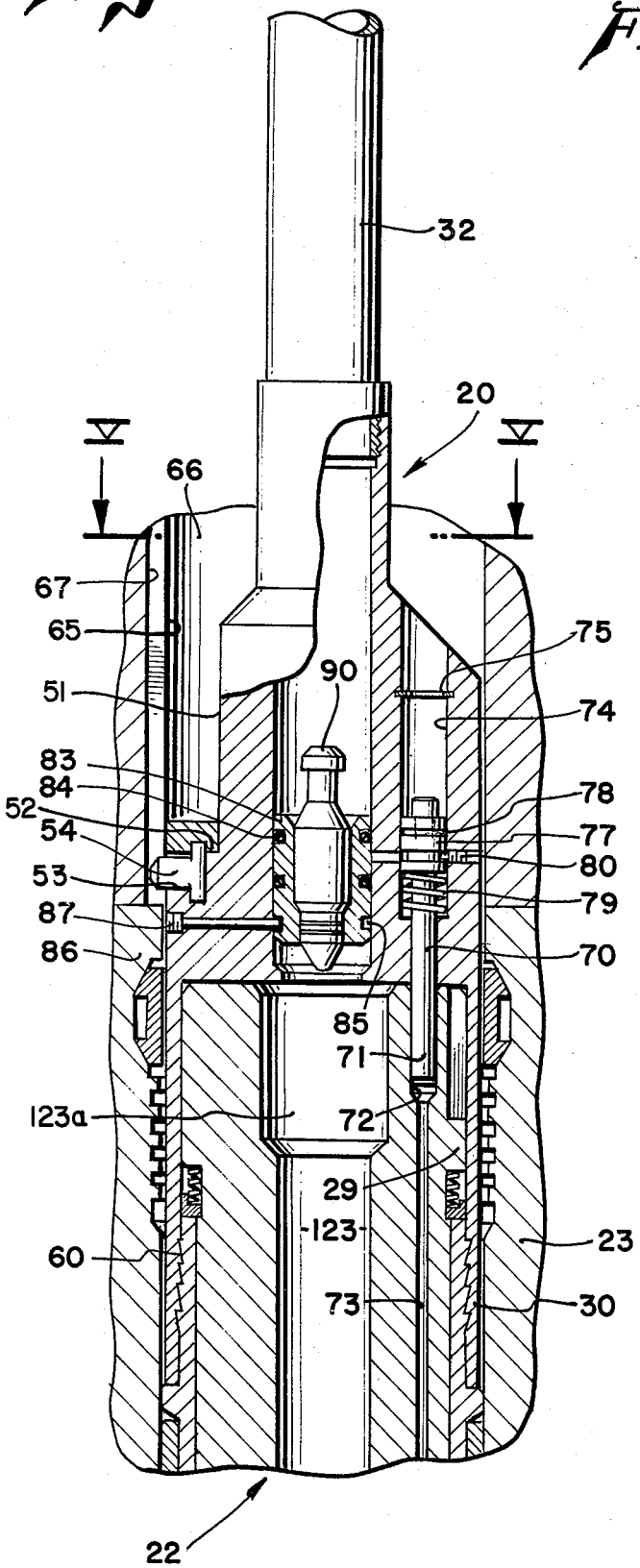
FIG. 3 is a fragmentary enlarged sectional view of the upper portion of the tubing hanger within a well casing in landed position and preparatory to retrieving the landing tool.
Figure 6:
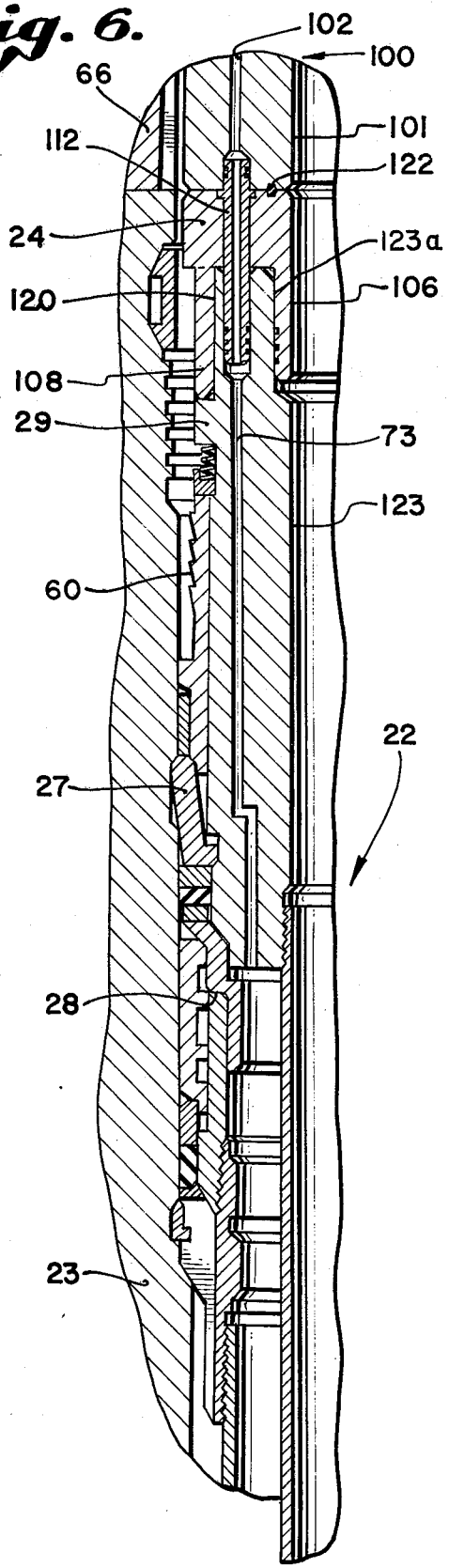
FIG. 6 is a fragmentary sectional view showing the tubing hanger equipped with an adaptor member to facilitate indexing and aligning of a tree assembly with the tubing hanger.
Figure 2:
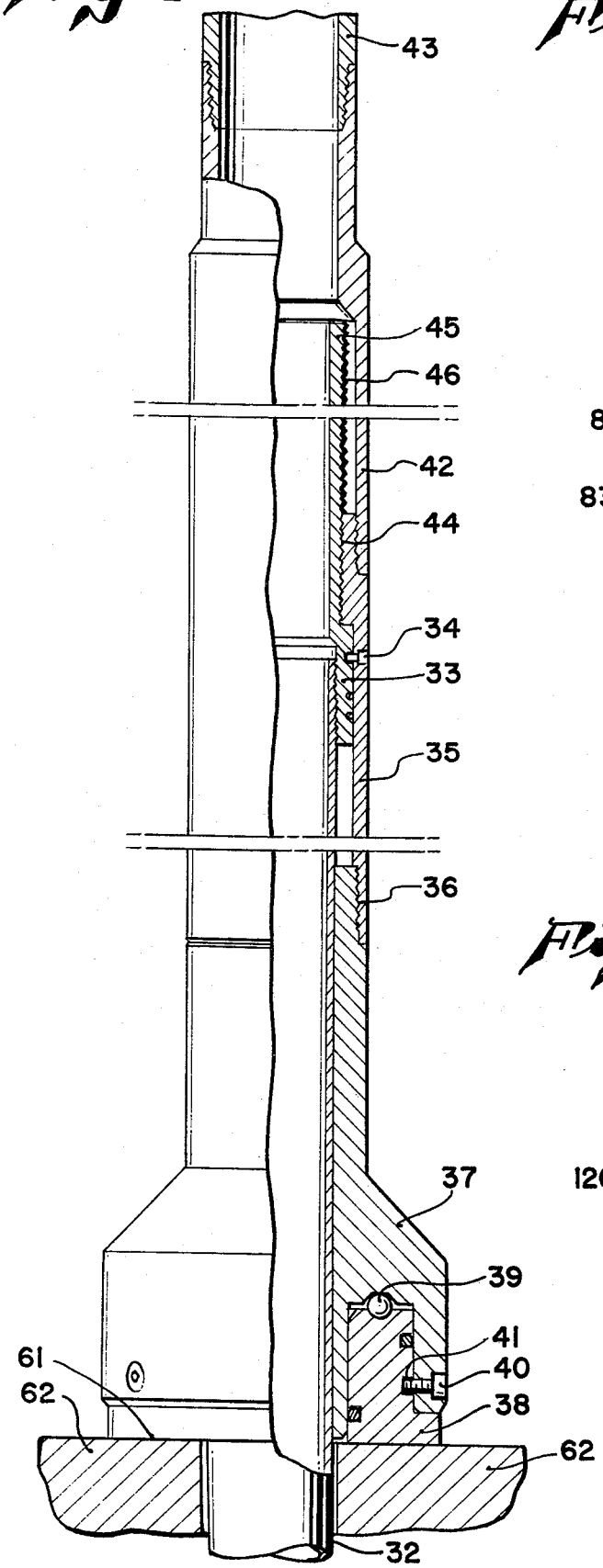
FIG. 2 is a fragmentary elevational view, partly in section, showing a portion of the landing tool located above the portion of the pipe string shown in FIG. 1.

Generally speaking, a landing tool 20 shown in FIGS. 1 and 2 provides a technique for landing a tubing hanger 22 in a well casing 23, FIGS. 3 and 6, in connection with the completion of a well hole for production. Landing tool 20 may be readily retrieved after completion testing. After such retrieval, the tubing hanger may be connected to a safety tree assembly through an adaptor member 24 of novel construction for indexing and aligning fluid conducting passageways on the safety tree assembly and on the tubing hanger in such a manner that tubular nipple members 25 are precisely and accurately guided into proper relationship with the passageways in the upper end of the tubing hanger.

Landing Tool and Landing Technique

As shown in FIGS. 1 and 2, landing tool 20 is adapted to carry a tubing hanger 22 which is provided with suitable fluid conducting passageways therethrough for annulus lines and for fluid control lines. Tubing hanger 22 may include a plurality of circumferentially arranged latches 27 for interlocking engagement with well casing 23 in well-known manner. As best seen in FIGS. 3 and 6, tubing hanger 22 may be landed at 28. Upper end of tubing hanger 22 includes a mandrel end 29 which is received within an internally threaded lower skirt 30 of the landing tool 20.

Landing tool 20 includes a landing tool stinger pipe portion 32 which extends upwardly, FIG. 2, for internal threaded engagement with the lower end of a sleeve member 33 initially secured against rotation by a shear pin 34 which interconnects a landing sub 35 which is threaded at 36 to a bearing swivel housing 37 which carries a swivel base 38. Between swivel base 38 and the swivel housing is provided a ball bearing antifriction means 39 to permit relative rotational movement between base 38 and bearing swivel 37. Cap screw 40 holds base 38 in assembly with swivel 37, the inner end of screw 40 being received in annular groove 41 on base 30.

Figure 5:
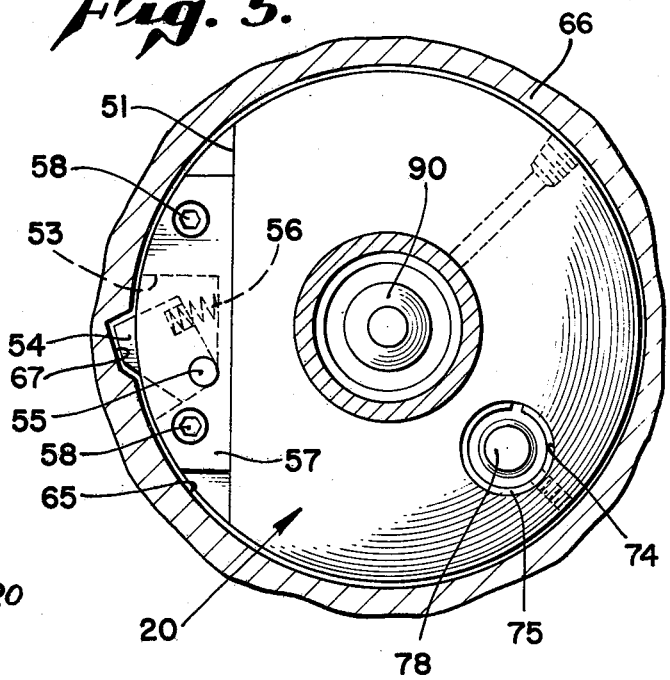
FIG. 5 is an enlarged fragmentary view taken in the plane indicated by line V — V of FIG. 3.

Lower sub 35 is threadedly connected to upper sub 42 which may be connected to pipe string 43 which extends to a vessel having a derrick, not shown, at the water surface. Sleeve member 33 has threaded engagement at 44 with the upper end of lower sub 35 and includes an upwardly directed sleeve extension 45 providing a selected length of external threads 46 to permit axial movement of pipe stinger portion 32 under certain rotational conditions as later described. Below base 38 of the swivel means 37, the landing tool body 50 includes a relief portion 51 which provides a ledge 52 having a recess 53 within which is pivotally mounted a latch 54. Latch 54 is mounted about a vertical axis or an axis parallel to the axis of the landing tool as indicated at 55 and is normally biased outwardly by springs 56. The latch 54 may be retained in recess 53 by a retainer plate 57 secured on opposite sides of recess 53 by screw bolts 58. Latch 54 is shaped to limit rotation in a clockwise direction as shown in FIG. 5 and to allow rotation in a counterclockwise direction.

In the method of landing a tubing hanger by a landing tool 20 as above described, tubing hanger 22 is threadedly connected to the lower skirt 30 of the landing tool by special threads 60 which resist rotation in the presence of tension forces acting on the threaded connection. The landing tool 20 is lowered by pipe string 43 until the swivel base 38 is seated as at 61 on a pair of rams 62 which may be provided on a blow out preventor located adjacent the well hole. Rams 62 embrace pipe string portion 32 with a relatively loose sliding fit. Rams 62 are brought into embracing position after body member 50 of the landing tool 20 has passed therebelow.

In such position of the landing tool and the tubing hanger 22 carried thereby, the tubing hanger is angularly oriented with respect to the landing tool 20 by lock piston means 70 as later described.

After base 38 has landed upon rams 62, the pipe string 43 may be rotated in one direction, for example the right-hand direction, thereby causing the landing tool body 50 to rotate to the right and causing the lock dog 54 to bear against the internal surface 65 of the casing wall 66 until dog 54 engages a vertically extending slot 67, dog 54 having been urged thereinto by biasing spring 56. Rotation in a right-hand direction is thereby stopped.

To advance the tubing hanger downwardly into its landed position, shear pin 34 is now sheared by further rotation to the right which is prevented by lock dog 54. Once pin 34 has been sheared, the pipe string 43 is rotated in the opposite direction or towards the left. Such rotation will cause the now nonrotatable landing tool body 50, pipe stinger portion 32 and the extension 45 to be advanced downwardly because of the threaded engagement at 44 with the now rotatable subs 42 and 35. Landing tool 20 advances downwardly until the tubing hanger is landed at 28 and the outwardly biased latches 27 engage the well casing to lock said tubing hanger in its selected position.

During landing of the tubing hanger and in landed selected position of the tubing hanger, the landing tool 20 had locked the tubing hanger against relative rotation by a ported lock piston 70 which had a lower end 71 extending into the upper enlarged passageway 72 of a passageway for fluid 73 provided in the tubing hanger for control or annulus purposes. Upper end of lock piston 70 extends into an enlarged bore 74 in tool 20 provided with a lock ring 75 to limit movement of the lock piston 70 in an upward direction under tool retrieval operations. Lock piston 70 includes an upper piston head 77 provided with suitable O rings 78 for sealing engagement with bore 74. A biasing spring 79 normally urges the lock piston 70 upwardly, such upward movement of the lock piston 70 being restrained by a shear pin 80 engaged in an annular groove in the piston head 77.

After the conducting certain tests, landing tool 20 is retrieved by the following procedure. It will be noted landing tool 20 includes a slidable sleeve 83 provided in the central throughbore or passageway of the landing tool. Sleeve 83 is provided with a pair of O rings 84 and with an annular groove 85 which is engaged by a shear pin 86 extending through body 50 and having its exterior opening sealed with a plug 87. Shear pin 86 holds sleeve 83 in the position shown in FIG. 3 in which sleeve 83 blocks a port 88 extending between the central passageway in the landing tool and the piston bore 74.

Figure 4:
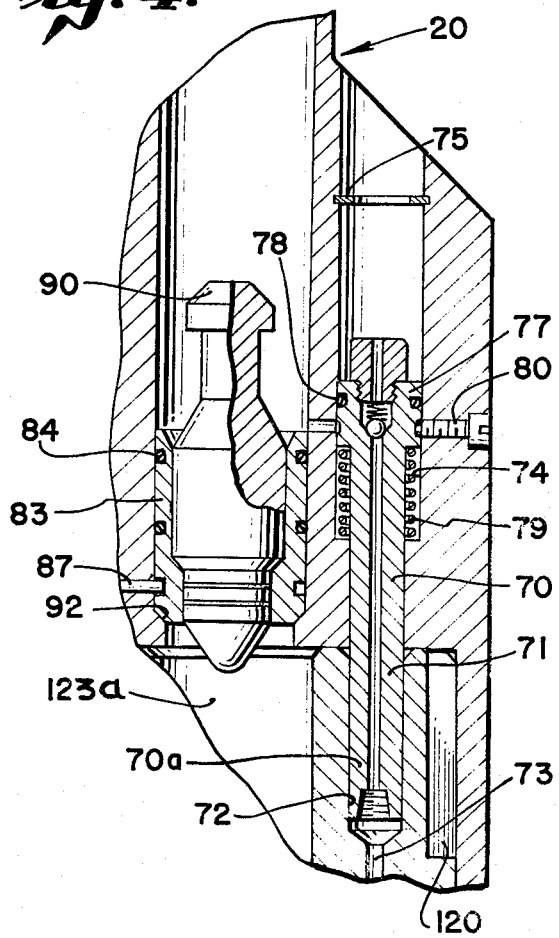
FIG. 4 is an enlarged fragmentary view illustrating another step in the retrieval of the landing tool.
Figure 9:
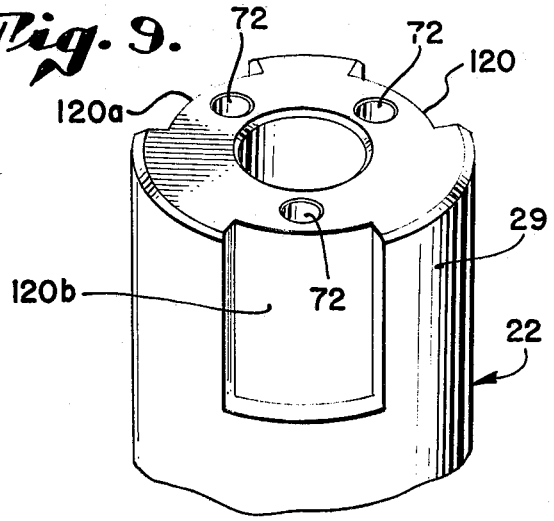
FIG. 9 is a perspective view of a top end of a tubing hanger including alignment means of this invention.

In the landing tool retrieval operation, a dart 90 may be dropped down the pipe string 43 and into the throughbore of the landing tool for final seating in the sleeve 83. Dart 90 may be made of solid material and plugs the opening in sleeve 83 which normally permits passage of fluid through the pipe string. Pressure fluid may now be applied through the central passageway of the pipe string 43 and landing tool 20 to cause the shear pin 85 to shear and release sleeve 83 so that it may slide downwardly into seated position at 92 as shown in FIG. 4. In down and seated position of sleeve 83 and dart 90, port 88 is exposed and open to pressure fluid which now enters the lock piston bore 74 below piston head 77. The pressure fluid acts upwardly against the piston head 77 and causes shearing of pin 80 which releases the lock piston which is now biased upwardly until it is seated against the lock ring or retainer 75. In this upper position the lower end **70*a* of the lock piston is withdrawn from the passageway 73 to thereby permit rotation of the pipe string to cause the threaded sleeve member 33 to be threadedly driven upwardly and thus applying a lifting force to the landing tool 20. Rotation of the landing tool is permitted by the cammed surface of the lock dog 54 and by the disengagement of the lock piston 70 with the tubing hanger. Landing tool 20 may be unthreaded from the mandrel threads 60. The upper end of the landed tubing hanger or the tubing hanger mandrel 29** is accessible and is available for further well operations.

Seal Adaptor Means

Figure 7:
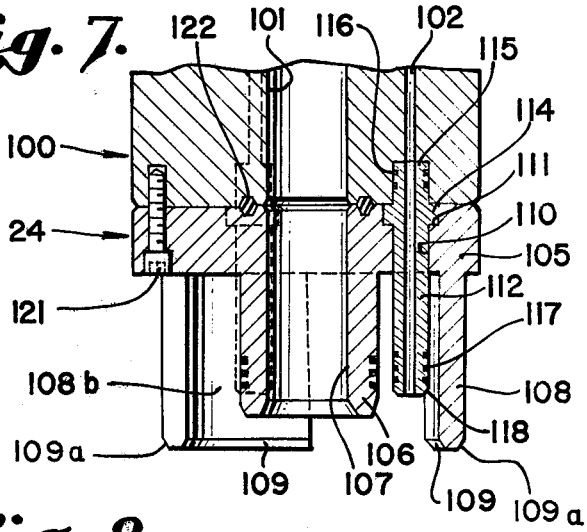
FIG. 7 is a fragmentary sectional view showing the adaptor member and a portion of a tree assembly to which the adaptor member is connected.
Figure 8:
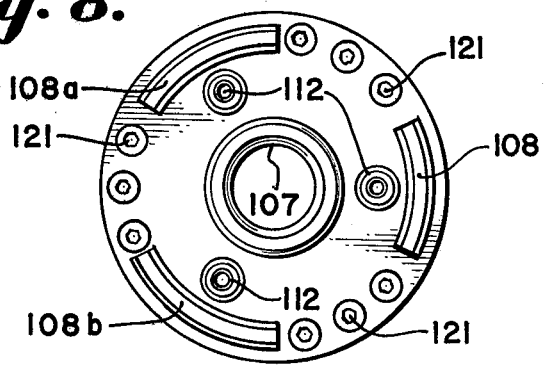
FIG. 8 is a bottom view of FIG. 7.

Such further well operations indicated above include the interconnection of the mandrel end 29 of the tubing hanger to a safety tree assembly, only a bottom portion of which is shown, for continuous production operation of the well. As best seen in FIGS. 6, 7 and 8, tubing hanger 22 is in a selected fixed nonrotative relationship in the well casing or wellhead. A safety tree assembly fragmentarily and generally indicated at 100 is provided with a central passageway 101 and control and annulus passageways, only one of which is illustrated in FIG. 6 and identified as passageways 102. It will be apparent that the fluid conducting passageways on the safety tree assembly 100 should be indexed and precisely aligned and sealed so that proper control of well hole operations can be made.

The present invention contemplates an adaptor means 24 for two such members to be connected in sealed relation, the adaptor means including a body member 105 provided with an inner hollow cylindrical portion 106 having a central throughbore 107 which defines a longitudinal axis. At spaced intervals along the outer peripheral margin of body member 105 may be provided elongated part-cylindrical or arcuate segments 108, 108*a* and 108*b*, said arcuate segments extending in the same direction as inner portion 106. Each arcuate segment 108, 108*a* and 108*b* has a length which is greater than the length of inner portion 106. Each arcuate segment includes inner and outer beveled edges 109 and 109*a*, respectively, serving as guide means as later described. Each arcuate segment 108, 108*a*, 108*b* is formed about the axis of inner portion 106 and each subtends an angle of different magnitude than the angle subtended by an adjacent arcuate segment. Alternatively, each arcuate segment 108 has a chord C of different length than the chord of each of the other arcuate segments.

Body member 105 is provided with bores 110 provided with upwardly facing countersunk shoulders 111 for reception of tubular nipple members 112. Each nipple member 112 has a collar 114 seated in the countersunk recess 111 for positioning tubular member 112 in body 105. As noted in FIG. 8, each tubular member 112 has an axis which lies on a radian within the arc subtended by its associated arcuate segment 108. Each tubular member 112 has a top end 115 provided with seal O rings 116 for sealing engagement with an enlarged counterbore in safety tree assembly 100. The bottom end of tubular member 112 includes a plurality of O rings 117 and a beveled bottom edge 118 for reception within the corresponding passageway in the mandrel end 29 of the tubing hanger. The length of tubular member 112, which extends parallel to the arcuate segments 108 and the inner portion 106, is less than the lengths of portion 106 and segments 108. The lower end of tubular member 112 is protectively spaced longitudinally within the extremities of portion 106 and segments 108 and laterally therebetween.

The mandrel upper end 29 is provided on its external surface with longitudinally extending recesses 120, 120*a*, 120*b* corresponding to the length and arcuate configuration of respective segments 108, 108*a* and 108*b*. Fluid passageways in the mandrel end 29 and in the safety tree assembly 100, to be joined by the tubular nipple members 112, are also correlated to the respective arcuate segments 108, 108*a*, 108*b* and recesses 120, 120*a*, 120*b*. Thus, proper angular alignment of the assembly 100 and mandrel 29 is assured by the proper mating of the arcuate segments and recesses.

Adaptor means 24 is secured to the safety tree assembly by suitable circularly spaced screw bolts 121 located in peripheral marginal portions of body member 105 between ends of adjacent arcuate segments 108, 108*a* and 108*b*. The interface between the safety tree assembly 100 and the adaptor means 24 is provided with suitable annular seals 122.

When the safety tree assembly is to be installed and connected to the tubing hanger, the adaptor member 24, secured on the bottom face of the safety tree assembly, is lowered along the axis of the safety tree assembly and the tubing hanger. It will be understood that such lowering of the safety tree assembly may be done by well-known guide lines and guide sleeve and post arrangements, such as shown and described in copending application Ser. No. 743,586 owned by a common assignee. As the adaptor member 24 moves into proximity with the upper end of the mandrel end 29, the adaptor member may be turned by turning the pipe string carrying the safety tree assembly and indexed into proper relationship with the mandrel end 29 by engagement of corresponding mating arcuate segments and recesses on the mandrel end. In the event of angular or azimuth misalignment, bottom edges of the arcuate segments 108, 108*a*, 108*b* will contact the upper end face of mandrel 29 at areas between the segment receiving recesses 120, 120*a*, 120*b* on the mandrel end and will thereby block further lowering of the safety tree assembly. In such misalignment condition, it will be noticed that the lower ends of the tubular nipple member 112 are spaced from tubing hanger mandrel end 29 and are thereby protected from damage which might be caused by contact under such misalignment. As the adaptor member and safety tree assembly is turned, it will be also apparent that the arcuate segments 108, 108*a*, 108*b* will not enter the arcuate recesses 120, 120*a*, 120*b* on the mandrel end unless the corresponding mating recess is in alignment with its arcuate segment. When such angular alignment is achieved and the segments are aligned with their corresponding respective arcuate recesses, the adaptor member may be moved axially into assembly with the mandrel end 29 and the arcuate segments fully received in their corresponding recesses.

During such final assembly stages, it will be apparent that the lower portions of the arcuate segments 108, 108*a* and 108*b* provide azimuth or angular alignment of the tubular nipple members 112 with their respective passageways, before the lower ends 118 of members 112 enter their respective passageways in the mandrel end and thereby provides additional coaxial alignment of the adaptor means 24 with mandrel end 29. When the adaptor member has been properly indexed, aligned with respect to both azimuth and longitudinal axis, the tubular members 112 will be coaxially aligned with their respective passageways in the mandrel end for precise entry without damage.

FIG. 6 illustrates final assembled relationship of a safety tree assembly 100 with mandrel end 29 utilizing an adaptor means such as 24. Arcuate segment 108 is fully seated in its corresponding recess 120 in the mandrel end 29 and inner portion 106 is received within the upper slightly enlarged portion 123*a* of the throughbore 123 of the tubing hanger 22. Conrol or annulus passageway 73 is in sealed communication with passageway 102 of the tree assembly 100 by the passageway provided in the tubular nipple member 112.

While the adaptor means 24 has been described with respect to its use in final stages of preparing the wellhead for production, it will be understood that such adaptor construction may be readily used during other stages of preparation of the wellhead, as for example, the completion test stage. It will also be understood that the construction of the adaptor means and the mandrel end may be used in other installations when necessary to precisely coaxially and angularly align or register two members to be connected by remote control means. The sealed interconnection of fluid conducting lines is a primary example of this invention; the coaxial and angular alignment features of the invention may be used in the interconnection of other types of lines.

Landing tool 20 provides a means for precise placement and installation of a tubing hanger or similar well tool equipment in a subsea wellhead or well casing in precise preselected angular or azimuth orientation of the tubing hanger in the casing. Such precise positioning of the tubing hanger includes precise location of the recesses 120, 120*a* and 120*b* in the mandrel end 29 and thereby determines the location of the entry to the control and annulus passageways in the tubing hanger. Thus, when the tree assembly with adaptor means 24 attached thereto is lowered for assembly with the tubing hanger, the orientation of the arcuate segments is in approximate alignment therewith. Mating of the arcuate segments with the mandrel recesses is accomplished only after the tree assembly and adaptor means carried thereby are positioned for precise interengagement with the mandrel end 29 by slight turning of the adaptor means. While seeking precise alignment, the interconnecting nipple members 112 are in a protected position wherein the seals carried thereby will not be subject to abrasion and possible damage.

Various modifications and changes may be made in the examples of the invention described above, and all such changes and modifications coming within the scope of the appended claims are embraced thereby.

I claim:

1. An adaptor means for aligning two members to be connected in sealed relationship, comprising:

a body member including an inner hollow cylindrical portion having a throughbore and defining a longitudinal axis, said inner portion having a preselected length;

at least two part-cylindrical segments spaced radially outwardly of said inner cylindrical portion and in concentric relation thereto, said segments having a length greater than the length of said inner portion;

said body member having a passageway between at least one of said segments and said inner portion adapted to receive a tubular member extending in the direction of said inner portion for a distance less than the length of said inner portion.

2. An adaptor means as stated in claim 1 wherein at least two of said part-cylindrical segments subtend arcs of different length.

3. An adaptor means as stated in claim 1 including a tubular member in said passageway in said body member, said tubular member having a length less than said inner portion and said segment.

4. An adaptor means as stated in claim 3 wherein said tubular member has an axis lying on a radian lying within the angle subtended by said part-cylindrical segment.

5. An adaptor means as stated in claim 3 wherein said tubular member includes a portion extending from said body member for sealing engagement with one of said members to be connected;

and means carried by said body member for securing said adaptor means to said one connector member

6. Means for interconnecting a tubing hanger with well equipment thereabove, said tubing hanger including a mandrel end provided with fluid conducting passageways and said well equipment including a member having fluid conducting passageways to be indexed, aligned, and placed in communication with said passageways in said mandrel end, comprising:

an adaptor body member secured to said well equipment member;

said body member including spaced arcuate segments extending toward said mandrel end;

said mandrel end including longitudinally extending recesses to receive said segments in one predetermined position;

and a tubular member carried by said adaptor body member radially inwardly of said segments and having a length less than the length of said segment and located for reception in a fluid conducting passageway in said mandrel end in only said one predetermined position, the difference in length of said tubular member and said associated arcuate segment restricting engagement of said tubular member with said mandrel end until said one position is determined.

7. A means as stated in claim 6 wherein each arcuate segment has a chord length matched by the chord length of only one of said mating recesses on said mandrel end.

8. Means as stated in claim 6 wherein each arcuate segment has a predetermined arc width different than an adjacent segment, a tubular member carried by said adaptor body member adjacent to one of said arcuate segments;

said tubular member having a length less than the length of said arcuate segments, and an end portion extending above said body member.

9. A means as stated in claim 6 wherein each of said arcuate segments include bottom beveled edges for guidance of said segments into engagement with said mandrel end.

10. In a method of landing a tubing hanger in a well casing comprising the steps of:

lowering said tubing hanger into the well casing by means of a pipe string having swivel means above said tubing hanger;

interposing rams to intercept and support said swivel means prior to landing of said tubing hanger;

rotating said tubing hanger by rotating said pipe string in one direction;

locking said tubing hanger against rotation at a selected angular position of said tubing hanger with respect to said well casing;

shearing a pin above said swivel means to permit rotation of said pipe string in an opposite direction;

rotating said pipe string in an opposite direction for advancing the pipe string portion connected to said tubing hanger below said swivel means;

and advancing said tubing hanger downwardly without rotation until said tubing hanger is landed.

11. In a method as stated in claim 10 including restraining said tubing hanger against rotation relative to said pipe string portion whereby said tubing hanger is indexed in an angular position when said tubing hanger is locked against rotation at a selected angular position in the well casing.

12. In a method as stated in claim 11 in which a landing tool is connected to said pipe string portion including the further steps of:

releasing the tubing hanger from its nonrotative relation with said pipe string portion;

and retrieving said landing tool.

13. In a method of landing a tubing hanger in a subsea wellhead, said tubing hanger being nonrotatively connected to a landing tool, and said landing tool being initially held in nonrotative relation with respect to a lowering of pipe string; the steps of:

lowering said tubing hanger into proximity with the wellhead;

supporting said tubing hanger and landing tool above said wellhead;

rotating said landing tool and tubing hanger in one direction until said landing tool is locked against rotation in said one direction;

releasing said landing tool and said pipe string from their nonrotative relation;

rotating said pipe string to lower said landing tool and tubing hanger without rotation thereof;

and landing said tubing hanger on said well casing with said tubing hanger and said landing tool in relative nonrotative relation.

14. A landing tool means adapted to be lowered by a rotatable pipe string to a subsea wellhead assembly; comprising:

a landing tool body member having means adapted to carry a well tool and to hold said well tool in selected angular orientation with respect thereto;

a pipe stinger means connected to said landing tool body member;

means threadedly connecting said pipe stinger means to said pipe string;

said connecting means including a sub means and a swivel means carried thereby;

said swivel means being adapted to be supported at a selected location above said well head assembly;

and engagement means on said landing tool body member adapted to cooperably slidably engage vertical slot means in said wellhead assembly to limit rotation of said landing tool body member in one direction while permitting relative axial movement of said landing tool body member relative to said wallhead assembly.

15. A landing tool means as stated in claim 14 including shear pin means between said sub means and said pipe stinger means for shearing after said landing tool body member has been limited in its rotation.

16. A landing tool means as stated in claim 15 wherein said threaded connection of said pipe stinger means to said pipe string after shearing of said shear means provides threaded lowering of said landing tool body member and well tool connected thereto by rotation of said pipe string.

17. A landing tool means as claimed in claim 14 wherein said means to hold said well tool in angular orientation includes a lock piston carried by the landing tool and extending into the well tool.

18. A landing tool means as claimed in claim 17 wherein said lock piston is biased in the direction of release from said well tool;

a shear pin between said lock piston and landing tool;

and means for shearing said shear pin to disengage said lock piston from said landing tool to allow rotation of the landing tool relative to said well tool.

19. Means for interconnecting a first member having an end provided with a passageway with a second member having a passageway to be indexed and aligned with said passageway in said first member, comprising:

an adaptor body member secured to said second member;

said body member including spaced arcuate segments extending toward said first member;

said first member including longitudinally extending recesses to receive said segments in one predetermined position;

and a tubular member carried by said adaptor body member radially inwardly of said segments and having a length less than the length of said segments and located for reception in a passageway in said first member in only said one predetermined position;

the difference in length of said tubular member and said associated arcuate segment restricting engagement of said tubular member with said first member until said one position is determined.

20. Means for interconnecting two members in end to end relation, said members having passageways to be aligned and placed in communication with respective passageways, comprising in combination:

an adaptor body secured to one of said members;

means on said adaptor body and means on one of said members interengageable to hold said body and said one member in a predetermined position;

a tubular element on one of said members having a length less than the length of said interengagement means for reception in a passageway in the other of said members in only one position;

the difference in length of said tubular element and said interengagement means restricting engagement of one member with the other member until said one position is determined.

21. A landing tool means adapted to be lowered by a rotatable pipe string to a subsea well; comprising:

a landing tool body member having means adapted to carry a well member and to hold said well member in selected angular orientation with respect thereto;

a pipe means threadably connected to said landing tool body member and to said pipe string;

means for supporting said well member and said landing tool body member above a selected point in said subsea well;

and engagement means on said landing tool body member adapted to cooperably, slideably engage vertical means in said well to limit rotation of said landing tool body member in one direction while permitting relative axial movement of said landing tool body member relative to said well;

said means to hold said well member in selected angular orientation including a tubular member carried by said landing tool body member and extending into said well member.

22. A landing tool means as claimed in claim 21 wherein said tubular member is a piston member biased in a direction to release said landing tool body member from said well member.

23. A landing tool means as claimed in claim 22 including a shear pin releasably retaining said piston member in assembly with said landing tool body member.

24. A landing tool means as claimed in claim 22 including stop means in said landing tool body member limiting movement of said piston member in released position.

25. A landing tool means as claimed in claim 22 including passageway means in said piston member;

and valve means in said passageway means restricting fluid flow to one direction.

26. A landing tool means as claimed in claim 21 including means for releasing said piston member from said well member.

27. A landing tool means as claimed in claim 21 wherein said means for supporting said well member includes a swivel means.

* * * * *